US007445509B2

(12) United States Patent
Korczynski

(10) Patent No.: US 7,445,509 B2
(45) Date of Patent: Nov. 4, 2008

(54) IN-LINE FUSE HOLDER FOR FEMALE FUSE

(75) Inventor: Jacek Korczynski, Niles, IL (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 11/452,456

(22) Filed: Jun. 14, 2006

(65) Prior Publication Data

US 2007/0293091 A1 Dec. 20, 2007

(51) Int. Cl.
*H01R 13/68* (2006.01)

(52) U.S. Cl. ..... 439/620.26; 439/620.33

(58) Field of Classification Search ..... 439/620.26, 439/620.29, 620.3, 620.33
See application file for complete search history.

(56) References Cited

U.S. PATENT DOCUMENTS 3,465,280 A * 9/1969 Paganelli ..... 439/140
3,993,380 A * 11/1976 Lumm, Jr. ..... 439/108
4,293,172 A * 10/1981 Lingaraju ..... 439/105
4,494,809 A * 1/1985 Soloman ..... 439/369
4,997,394 A * 3/1991 Katz et al. ..... 439/620.33
5,398,015 A * 3/1995 Kudo et al. ..... 337/255
5,444,428 A * 8/1995 Carr et al. ..... 337/188
5,885,109 A * 3/1999 Lee et al. ..... 439/652
6,371,794 B1 * 4/2002 Bauer et al. ..... 439/404
7,044,761 B2 * 5/2006 Sokol et al. ..... 439/263
2005/0101171 A1 * 5/2005 Ramsey et al. ..... 439/215
2005/0128045 A1 * 6/2005 Lin ..... 337/186

* cited by examiner

*Primary Examiner*—Tho D Ta
*Assistant Examiner*—Travis Chambers
(74) *Attorney, Agent, or Firm*—Armstrong Teasdale LLP

(57) ABSTRACT

An in-line fuse holder, assembly and system for plug in connection to a female fuse.

35 Claims, 8 Drawing Sheets

IN-LINE FUSE HOLDER FOR FEMALE FUSE

BACKGROUND OF THE INVENTION

This invention relates generally to electrical fuses, and more specifically to fuses holder for female fuses.

Fuses are widely used as overcurrent protection devices to prevent costly damage to electrical circuits. Fuse terminals typically form an electrical connection between an electrical power source and an electrical component or a combination of components arranged in an electrical circuit. A fusible link or fuse element assembly is connected between the fuse terminals, so that when electrical current flowing through the fuse exceeds a predetermined limit, the fusible link melts and opens the circuit through the fuse to prevent electrical component damage.

A variety of fuse holders are available to facilitate line and load connections to fuses in electrical systems. In certain installations, such as in an automotive electrical system, fuses are installed in locations that can be difficult to access, and are subject to harsh operating environments. Installing and servicing certain types of fuses in such a system is challenging.

DETAILED DESCRIPTION OF THE INVENTION

Exemplary embodiments of the present invention are described herein that provide convention installation and replacement of fuses, and protection of fuses for certain types of fuses that are incompatible with existing fuse holders.

One type of electrical system that presents particular challenges to fuse installation and replacement of opened fuses is a vehicle electrical system. Various types and configurations of fuses may be used in a modern vehicle, and large numbers of fuses are required to protect an ever increasing number of electrical components and accessories in the vehicle. Indeed, an entire industry of automotive fuses, fuse holders and accessories has been established to meet the needs of vehicle manufacturers and maintenance and repair firms.

Plug-in fuses having male contact blades, for example, have been developed for use with wiring harnesses in under-the-hood installations, or alternatively that may be used standard fuse blocks interior to the vehicle. A variety of in-line fuse holders have also been developed for convenience in installing such fuses.

Fuses having integral female terminals have also been developed and are increasingly being used in truck, bus, and automotive applications. Female fuses are typically used with compatible fuse blocks having contact blades that are inserted into the fuses, but it would be desirable in certain instances to connect them to wiring harnesses. In such a manner, a single fuse could be provided to a circuit without having to retool an existing fuse block or utilize an additional fuse block at another location in the vehicle, thereby adding flexibility to circuit protection at a reduced cost. However, connecting such female fuses to wiring harnesses is difficult and typically would require spliced line and load connections and separate connector components. Securing the female fuse housings in a desired location is also difficult when using them with wiring harnesses, as the female fuse housings generally lack any structure to mount them in place.

Additionally, known female fuses are not well suited for harsh operating environments encountered in, for example, under-the-hood installations in a vehicle. Protective enclosures, however, for such fuses may render the fuses difficult to locate for replacement, and may hide color-coded identification features and rating indicia commonly printed on outer surfaces of the fuses. Thus, when servicing the fuse, neither the location of the fuse nor the type of fuse may be apparent if the fuses are enclosed. Each of these factors can be an impediment to efficient replacement of fuses, and any delay in replacing an opened fuse is of course undesirable. Full operation and functionality of the electrical system will not occur until opened fuses are replaced.

Figure 1:
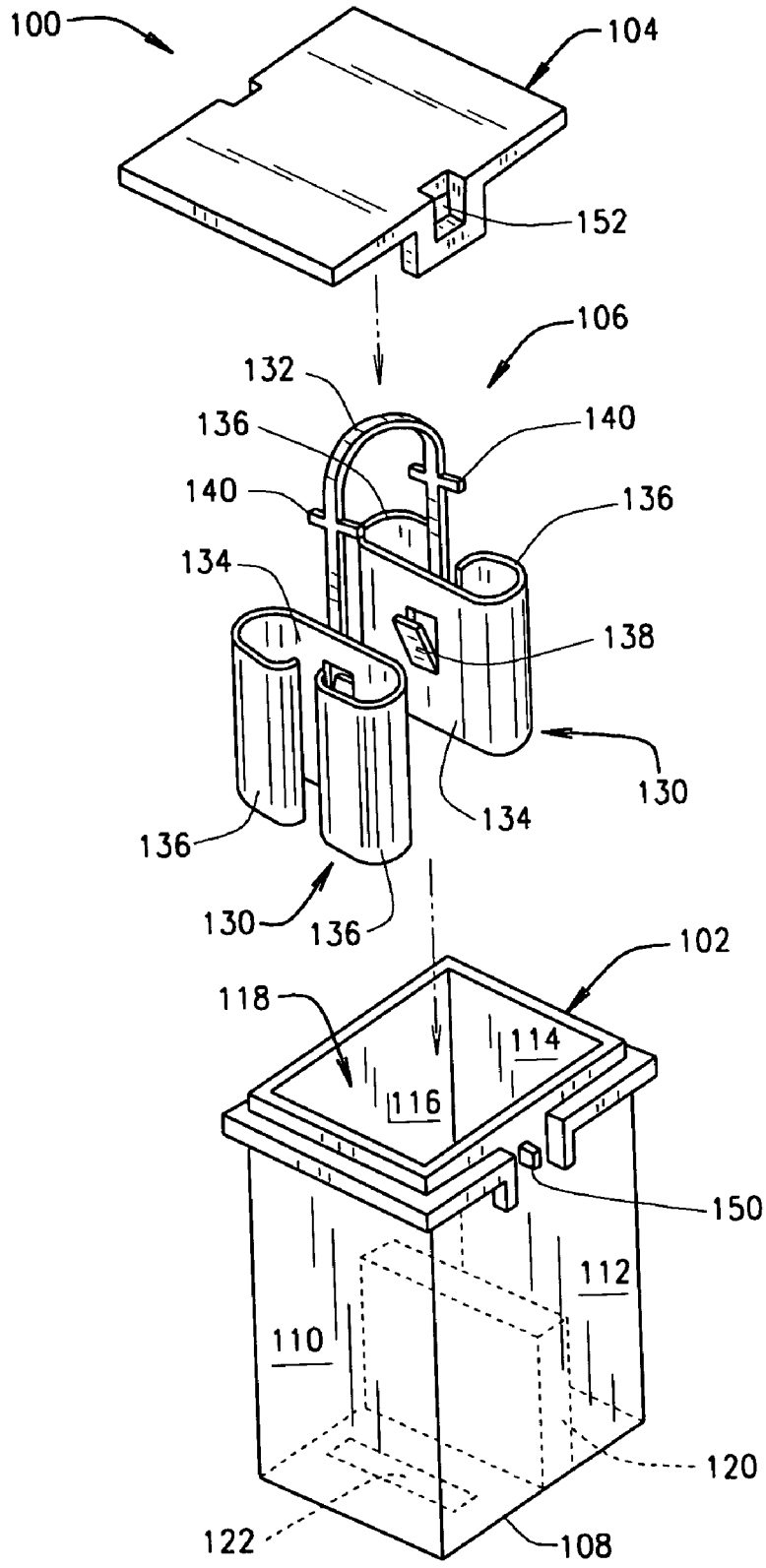
FIG. 1 is an exploded view of an exemplary fuse that may be used with a fuse holder of the present invention.

FIG. 1 is an exploded view of a known fuse 100 which is susceptible to the problems noted above in, for example, a vehicle installation. Exemplary embodiments of fuse holders, explained below, when used in combination with a fuse such as the fuse 100, overcome the noted problems and difficulties that such fuses present in some installations. While the fuse 100 may be particularly advantageous for vehicular applications, including automobiles, trucks, buses, recreational vehicles and marine applications, to name a few, it is understood that the fuse holder of the invention may be used with other types of fuses and that the fuse and fuse holder described below may be used in other applications while realizing at least some of the benefits of the invention.

The fuse 100, as those in the art will no doubt recognize, has achieved some acceptance in the automotive industry and is sometimes referred to as a J Case Style Cartridge Fuse in the industry. Such fuses are commercially available and provide high current circuit protection for automotive and vehicle applications. For example, one such commercially available fuse is a Female Maxi™ Fuse of Cooper/Bussmann, St. Louis, Mo.

As depicted in FIG. 1, the fuse 100 includes a rectangular plastic housing 102, a plastic cover 104 coupled to a top end of the housing 102, and a fuse element 106 enclosed by the housing 102 and the cover 104. The plastic housing 102 may include a bottom wall 108 and four side walls 110, 112, 114 and 116 extending upwardly from side edges of the bottom wall 108. The housing side walls 110, 112, 114 and 116 may define a generally rectangular terminal cavity 118 therebetween. A partition wall 120 (shown in phantom in FIG. 1) may be integrally formed with and may extend upwardly from the bottom wall 108 in a parallel relation to two of the opposing side walls 110 and 114 of the housing 102. The partition wall 120 may further be integrally formed with and may interconnect the remaining opposed side walls 112 and 116 of the housing 102.

The partition wall 120 subdivides the terminal cavity 118 into first and second terminal receiving portions, and the partition wall 120 extends vertically in the terminal cavity for a distance that is less than the vertical height of the side walls 110, 112, 114 and 116 measured from the bottom wall 108 toward a top edge of the side walls 110, 112, 114 and 116. The terminal cavity 118 is open at the top edges of the housing side walls 110, 112, 114 and 116, allowing the fuse element 106 to be inserted therein through the open top of the housing 102.

The bottom wall 108 of the housing 102 includes slots 122 (one of which is shown in FIG. 1) on either side of the partition wall 120 for receiving blade terminals of a connecting component (explained below), thereby providing electrical connection to line-side and load-side circuitry and components.

The fuse element 106 may be stamped and formed from a sheet of conductive material into female terminal portions 130 and a fusible link 132 extending therebetween. The female terminal portions 130 may be arranged in a generally parallel and spaced apart configuration, and the fusible link 132 may extend from an upper edge of each of the female terminal portions 130 and connect the female terminal portions 130 to one another.

The female terminal portions 130 may be formed into a generally rectangular configuration having a generally planar side wall 134 having side edges 136 that are curled or wrapped to define female terminals for receiving and engaging male terminal blades of a connecting component. The planar side wall 134 of the female terminal portions 130 may include a deflectable latch tab 138 extending obliquely therefrom. As the fuse element 106 is inserted into the terminal cavity 118 in the housing 102, the respective latch tabs 138 of the female terminal portions 130 are compressed by the opposing sides of the partition wall 120, and once the latch tabs clear a locking ledge (not shown) in the partition wall 120, the latch tabs 138 resiliently deflect outwardly and abut the locking ledge to secure the female terminal portions 130 to the housing 102. The fuse element 106 is therefore maintained in a predetermined location within the housing and is not intended to be removed from the housing 102.

The fusible link 132 is curved or bent between the female terminal portions 130 in a U-shaped configuration which bridges or joins the female terminal portions 130. The fusible link 132 is constructed to have a cross sectional area which may only withstand certain current conditions when coupled to an energized electrical circuit. When subjected to an overcurrent condition, for example, the fusible link 132 melts, disintegrates, or otherwise structurally fails and opens the electrical circuit between the female terminal portions 130. The fusible link may be constructed for ampere ratings, for example, from 20A to 80A.

Optionally, time delay tabs 140 may be integrally formed with the fusible link 132 and are folded upon one another in a T-shaped configuration at a distance from the upper edge of each of the female terminal portions 130, and the fusible link 132 is curved between the time delay tabs 140. The fusible link 132 may be of substantially constant cross sectional area between the time delay tabs 140 and may extend continuously and directly between the time delay tabs 140. Alternatively, the fusible link 132 may include lateral bends, sidewardly extending portions which would otherwise deviate from a longitudinal axis of the fusible link 132 and/or areas of reduced cross sectional area between the female terminal portions 130. Positive temperature coefficient materials, or other treatments known in the art may be applied to the fusible link 132 to modify the fusing characteristics thereof.

When the fuse element 106 is located within the housing 102, the female terminal portions 130 are placed in the respective subdivisions of the terminal cavity 118 on opposite sides of the partition wall 120, and the fusible link 132 extends and curves over the top of the wall 120 and joins the female terminal portions 130. The female terminal portions 130 are located proximate the slots 122 in the housing bottom wall 108 so that when blade terminals of a connecting component are inserted in the slots in the housing bottom wall, the female terminal portions 130 engage the blade terminals and complete an electrical connection through the fusible link 132.

The cover 104 may be fabricated from a plastic material and may be mounted to the top of the housing 102 via a latch protrusion 150 formed in the housing 102 near an upper edge thereof, and a latch recess 152 formed in the cover 104. The cover 104 may be engaged to the housing 102 with snap-fit engagement and encloses the top end of the terminal cavity 118 after the fuse element 106 has been inserted therein and retained to the locking ledges of the partition wall 120. The cover may be transparent to allow visual observation of the fusible link 132 through the cover 104, and the cover 104 may be marked with amperage and/or voltage ratings for the fuse element 106.

Figure 2:
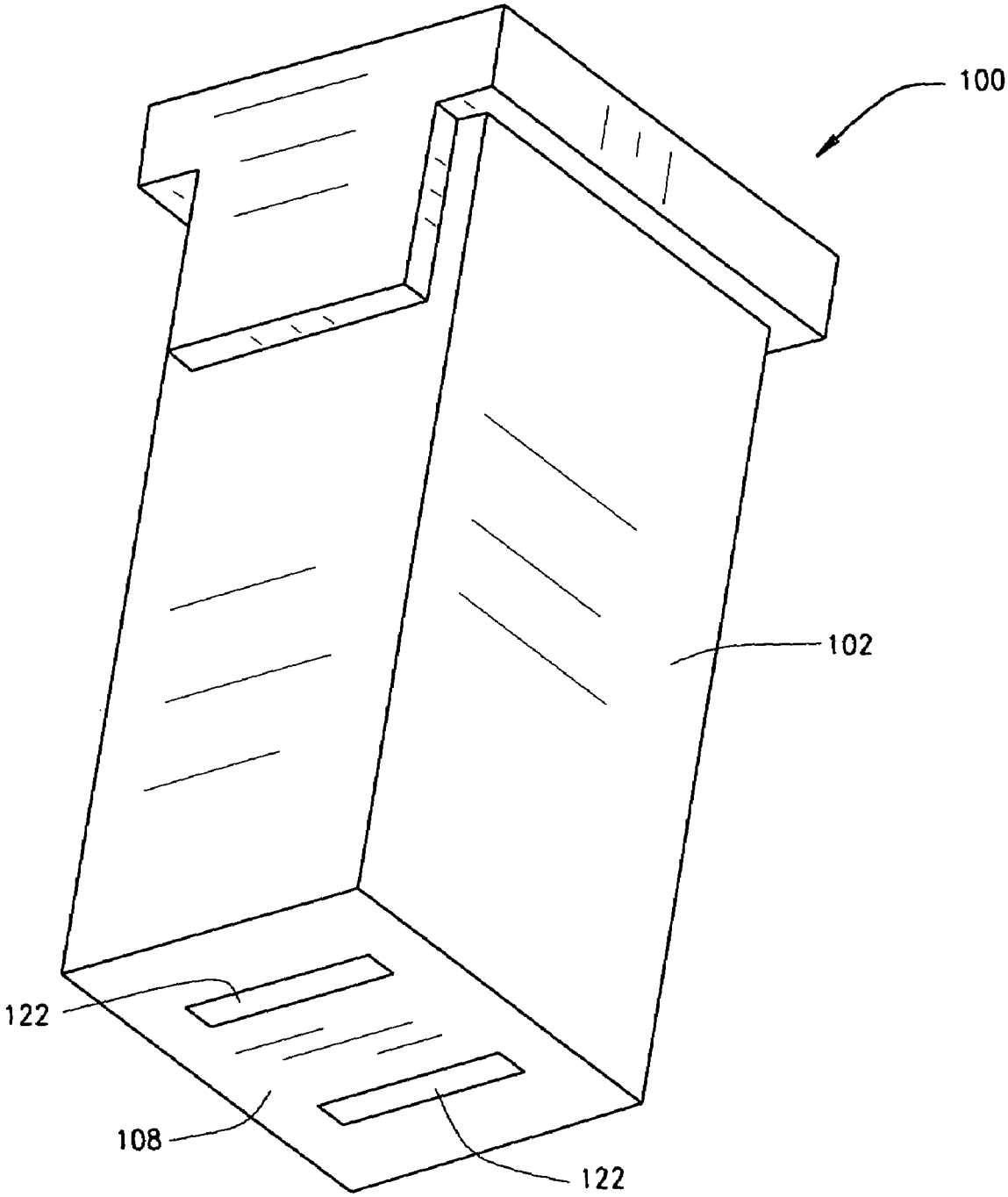
FIG. 2 is a bottom perspective view of the fuse shown in FIG. 1.

FIG. 2 is a bottom perspective view of the fuse 100 illustrating the slots 122 in the housing bottom wall 108. The slots are sized and dimensioned to accept contact blades of a specified size, and when the contact blades are inserted into the slots 122, they are received in the female terminal portions 130 (FIG. 1) to establish electrical connection to the fusible link 132.

Figure 3:
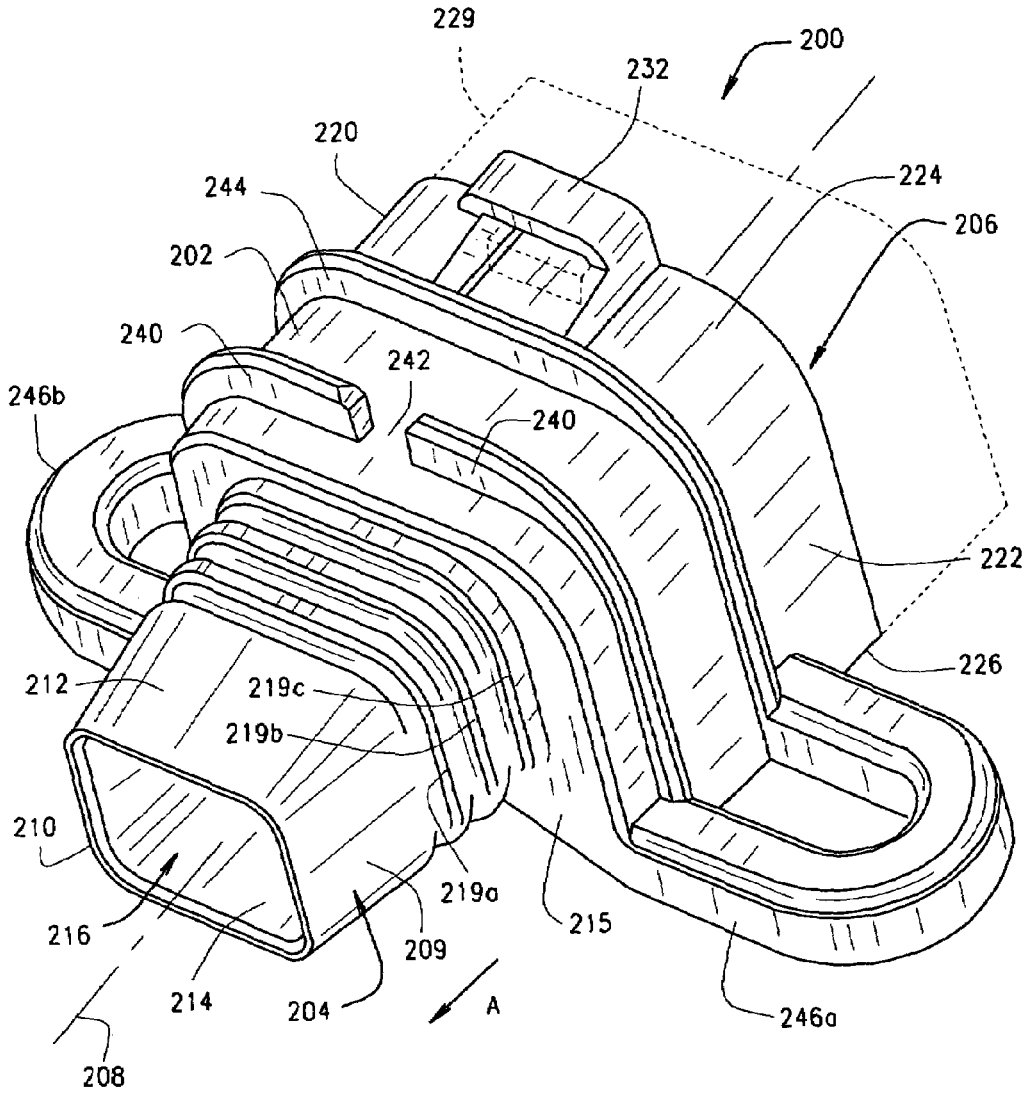
FIG. 3 is a perspective view of a fuse holder according to an exemplary embodiment of the present invention.
Figure 4:
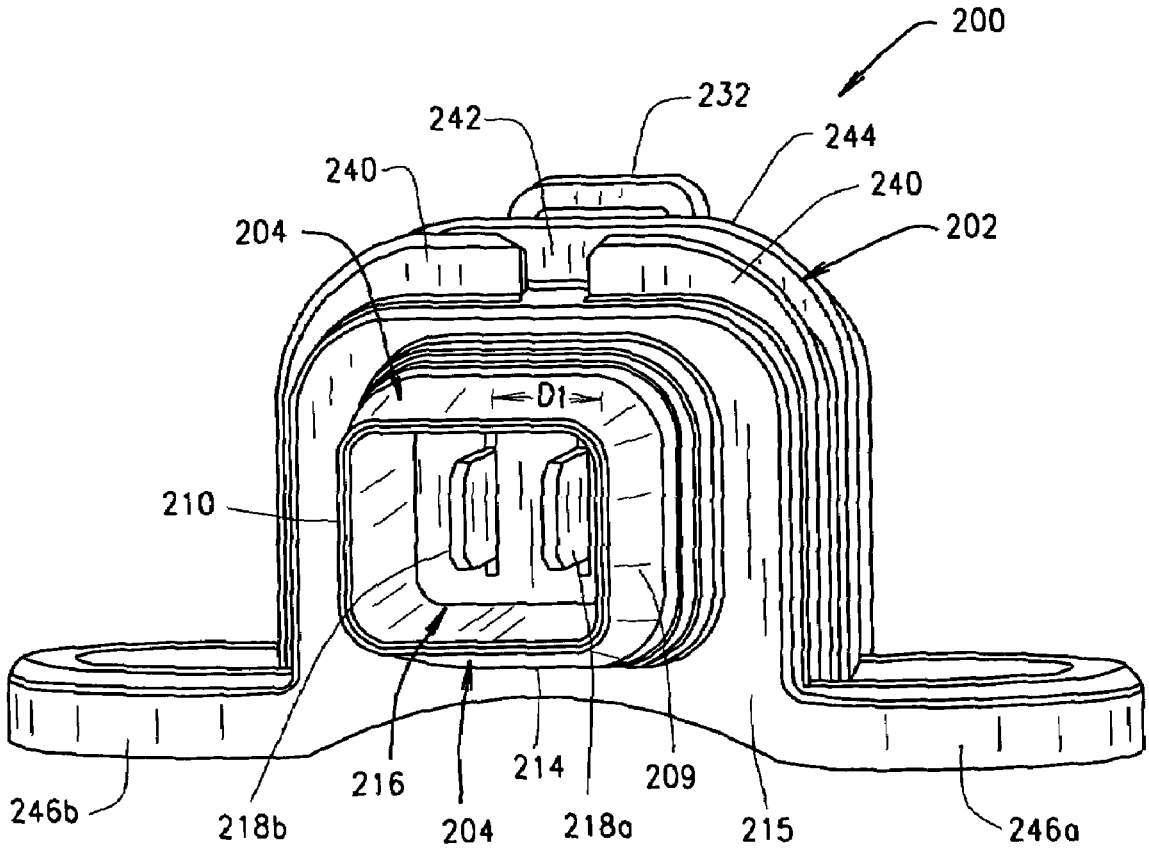
FIG. 4 is a front perspective of the fuse holder shown in FIG. 3.
Figure 5:
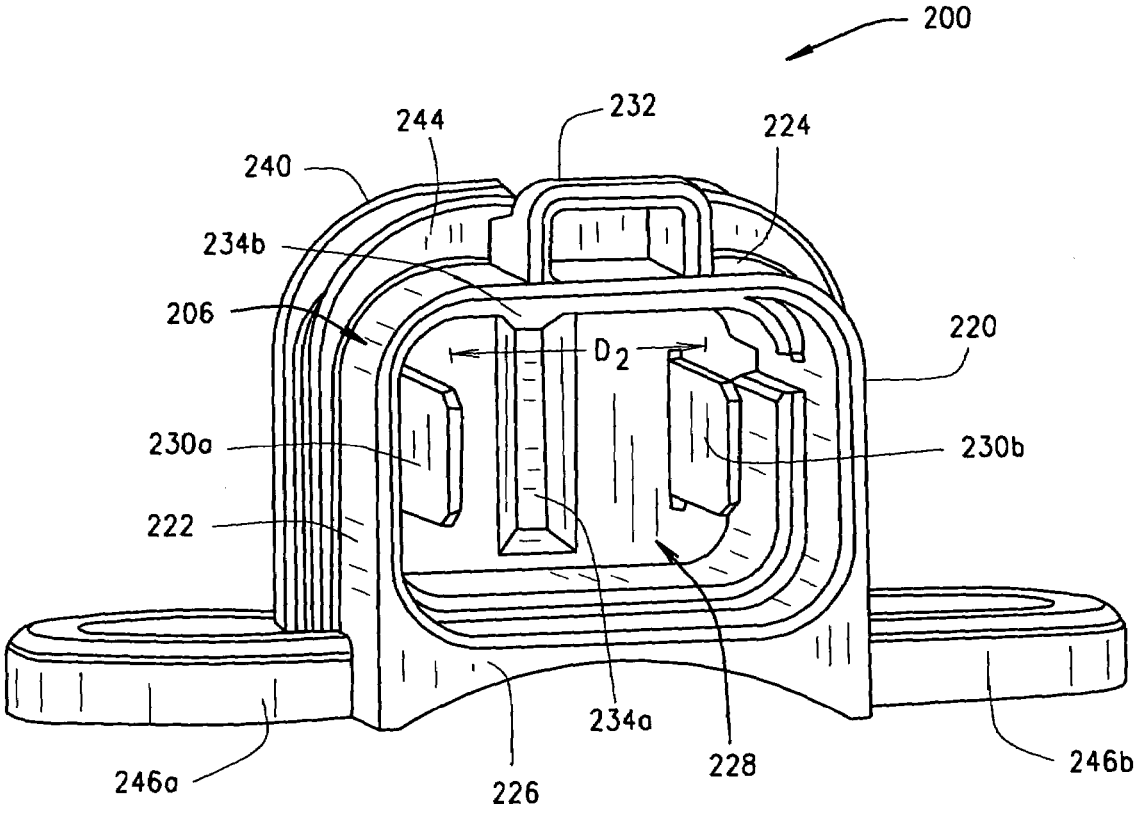
FIG. 5 is a rear perspective of the fuse holder shown in FIG. 3.

FIGS. 3-5 are a perspective view of a fuse holder 200 formed in accordance with an exemplary embodiment of the present invention. The fuse holder 200 is believed to be particularly advantageous with the fuse 100 in an vehicle electrical system, but it is understood that the fuse holder 200 may be used with other types of fuses, and for other circuit protection applications besides vehicle electrical systems. That is, it is contemplated that the benefits of the fuse holder 200 may be realized with other types of fuses and to provide circuit protection to other electrical systems. The fuse 100 and vehicle electrical system described herein are therefore provided for purposes of illustration rather than limitation.

As shown in the Figures, the fuse holder 200 may include a housing 202 defining a fuse receptacle portion 204 and a connector portion 206. The housing 202 may be formed integrally with the fuse receptacle portion 204 and the connector portion 206, and may be fabricated from heavy duty plastic according to a known molding operation, although other materials and fabrication techniques known in the art may alternatively be used.

The fuse receptacle portion 204 and the connector portion 206 face in opposite directions to one another and are generally aligned along a longitudinal axis 208 of the fuse holder 200. That is, in an exemplary embodiment the fuse receptacle portion 204 and the connector portion 206 are oriented about 180° from one another and are generally centered upon the longitudinal axis 208. In alternative embodiments, however, it understood that the fuse receptacle portion 204 and the connector portion 206 may be staggered or offset from one another along the axis 208 of the fuse holder 200, or the fuse receptacle portion and the 204 and the connector portion 206 may be oriented relative to one another at another orientation in lieu of the opposing, 180° separation illustrated in the Figures.

As best seen in FIGS. 3 and 4, the fuse receptacle portion 204 may include side walls 209, 210, 212 and 214 projecting from a front surface 215 of the housing 202 and defining a generally rectangular fuse receptacle or cavity 216 sized and dimensioned to receive a lower end of the housing 102 (FIGS. 1 and 2) of the fuse 100. The side walls 209, 210, 212 and 214 may be inwardly tapered toward the longitudinal axis 208 (FIG. 3), giving the fuse receptacle portion 204 a slightly conical shape in the direction of arrow A from the front face 215 to a distal end of the fuse receptacle portion 204. Contact blades 218 protrude from the housing 202 into the cavity 216 in the fuse receptacle portion 204. The contact blades 218 are dimensioned and positioned relative to one another to be inserted through the slots 122 (FIG. 2) in the housing 102 of the fuse 100 and establish electrical connection between the contact blades 218*a*, 218*b* and the female terminal portions 130 (FIG. 1) of the fuse 100 when the housing 102 of the fuse is inserted into the receptacle 216.

A series of sealing ribs 219 may be formed in the fuse receptacle portion 204 and project outwardly from the side walls 209, 210, 212 and 214 adjacent the front surface 215 of the housing 202. The sealing ribs 219 circumscribe the fuse receptacle portion 204 and cooperate with a protective cover, described below, to provide a buffer and some degree of protection for the fuse receptacle portion 204 from harsh operating environments. While three sealing ribs 219*a*, 219*b*, and 219*c* are illustrated in FIGS. 3 and 4, it is understood that greater or fewer numbers of sealing ribs 219 may be provided in other embodiments.

As best seen in FIG. 5, the connector portion 206 may include side walls 220, 222, 224 and 226 projecting away from the front surface 215 (FIG. 3) of the housing 202 and away from the receptacle portion 204. The side walls 220, 222, 224 and 226 may define a generally rectangular connector receptacle or cavity 228 sized and dimensioned to receive a complementary shaped mating connector component. In exemplary embodiments, the connector component may be integrated into a wiring harness, or may be a separate connector component 229 (shown in phantom in FIG. 3) providing connection to a wiring harness.

Contact blades 230*a*, 230*b* protrude from the housing 202 into the cavity 228 in the connector portion 206 The contact blades 230*a*, 230*b* are extensions of the respective contact blades 218*a*, 218*b* in the fuse receptacle portion 204 and establish pass-through electrical connection between the fuse receptacle portion 204 and the connector portion 206. The contact blades 230*a* and 230*b* are dimensioned and positioned relative to one another for mating engagement with terminals of the connector component 229 and establish electrical connection between the contact blades 230*a*, 230*b* and the terminals of the connector component 229. The terminals of the connector component 229 may, for example, be electrically connected to conductors of a wiring harness in a known manner.

As one example, the connector portion 206 may be configured for compatibility with a known connector 229 having, for example, Series 800 terminals that are commercially available from Delphi/Packard Electrical Systems of Troy, Mich. Using such a connector 229, line and load connections to output wires, cables, or harnesses connected to electrical components, circuitry, or equipment in a vehicle may be established conveniently and quickly with snap-fit engagement. The connector 229 may be sealed to provide moisture-proof connections to the fuse holder 200, which can be particularly advantageous in specialty vehicle applications operated in extreme environments. Other connectors may be used in lieu of the connector 229, however, in alternative embodiments.

The connector portion 206 may be formed with a latch element 232 on one of the side walls 224. The latch element 232 cooperates with a complementary latch feature of the connector 229 to provide terminal position assurance between the mating connector terminals and the contact blades 230*a* and 230*b* in known manner. Additionally, the cavity 228 may include polarizing or rejection features, 234*a* and 234*b*, sometimes referred to as keys, that cooperate with complementary features on the connector 229 in a tongue and groove or slot and key arrangement so as to frustrate any attempt to install the wrong connector or install the connector backwards into the connector portion 206. Stated another way, the features 234*a* and 234*b* permit only a one-way installation of the correct connector, while positively resisting installation of the connector in another way, and while resisting installation of the wrong connector to the fuse holder 200.

Comparing FIGS. 4 and 5, the contact blades 218*a* and 218*b* of the fuse receptacle portion 204 are spaced a first distance $D_1$ from one another, while the contact blades 230*a* and 230*b* of the connector portion 206 are spaced a second distance $D_2$ from one another. In the illustrated embodiment, the distance $D_1$ corresponds to the spacing of the female terminal portions 130 (FIG. 1) in the fuse 100, while the spacing $D_2$ corresponds to the spacing of the terminals in the connector component 229. More particularly, the spacing $D_2$ corresponds to standardized dimensions for known connector components, such as the connector 229, while the spacing $D_1$ corresponds to a standard dimension for the fuses 100. As is evident from the Figures, the distance $D_2$ is greater than the distance $D_1$. Also, as shown in FIGS. 4 and 5, the contact blades 230*a* and 230*b* in the connector portion 206 may be comparatively larger than the contact blades 218*a* and 218*b* in the fuse receptacle portion.

The housing 202 may further include a cover abutment flange 240 spaced from the fuse receptacle portion 204 and projecting outwardly form the housing 202. The cover abutment flange 240 may be formed with a gap 242 that may be used to secure a protective cover to the housing 202. A second flange 244 may also be provided and may project outwardly form the housing 202 in a spaced relation to the cover abutment flange 240. Optionally, a tie wrap (not shown) may be positioned between the flanges 240 and 242 and wrapped around the housing for mounting of the housing 202 in a desired location. The second flange 244 may not include a gap similar to the gap 242 in the cover abutment flange 240. The second flange 244 may also serve to secure a protective cover to the housing 202 in the manner explained below.

Mounting lugs 246*a* and 246*b* may be provided and may extend from the side walls 220 and 222 at lower edges thereof. The mounting lugs 246*a* and 246*b* extend generally perpendicular to the longitudinal axis 208 of the fuse holder 200 and at right angles to the fuse receptacle cavity 216 and the connector receptacle cavity 228. Using the mounting lugs 246*a* and 246*b*, the fuse holder 200 may be surface mounted to, for example, a vehicle chassis, the mounting lugs 246*a* and 246*b* may be used to through-hole mount the fuse holder 200 using known fasteners (such as screws or bolts), or alternatively the lugs 246*a* and 246*b* may serve as cable ties to secure the fuse holder 200 in place.

Figure 6:
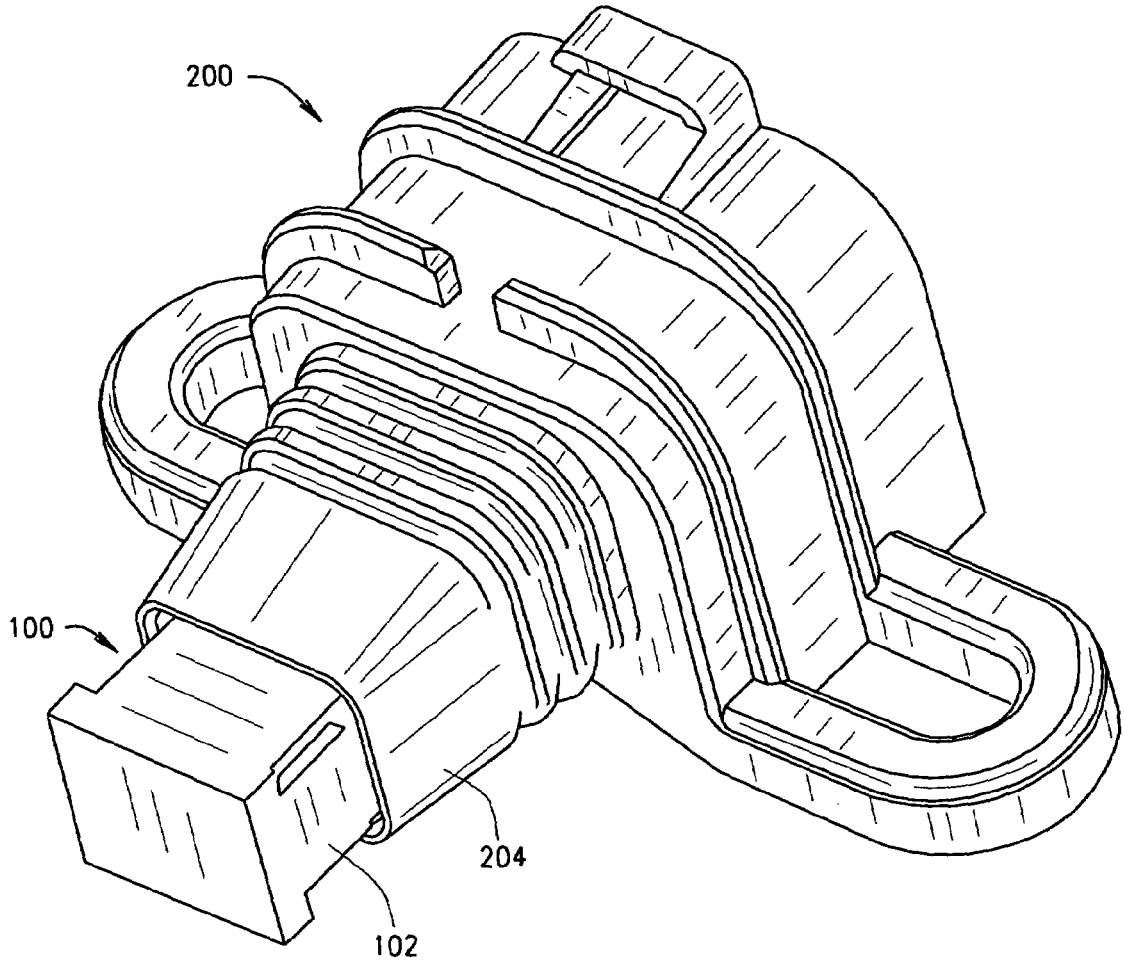
FIG. 6 illustrates the fuse holder shown in FIG. 3 with the fuse shown in FIG. 1 installed.

FIG. 6 illustrates the fuse holder 200 with the fuse 100 installed in the fuse receptacle portion 204. When so installed, the contact blades 218*a*, 218*b* of the fuse receptacle portion 204 are in mating engagement with the female fuse terminal portions 130 of the fuse 100, and electrical connection is established through the fusible link 132 of the fuse element 106.

As seen in FIG. 6, a substantial portion of the fuse housing 102 extends beyond the fuse receptacle portion 204 and is exposed when the fuse is installed in the fuse holder 300. As such, the sides of the fuse housing 102 may be grasped to pull the fuse 100 from the fuse holder 200 for replacement. The exposed fuse 100 may be pulled by hand and without the use of tools for convenient replacement of the fuse 100. Also, the exposure of the fuse 100 reveals the cover 104 of the fuse 100 for visual inspection. As previously mentioned, the cover 104 is typically color coded and includes indicia for the ratings of the fuse. Additionally, the cover 104 is typically transparent to facilitate visual inspection of the fusible link 132 without having to remove the fuse 100 from the fuse holder 200.

Figure 7:
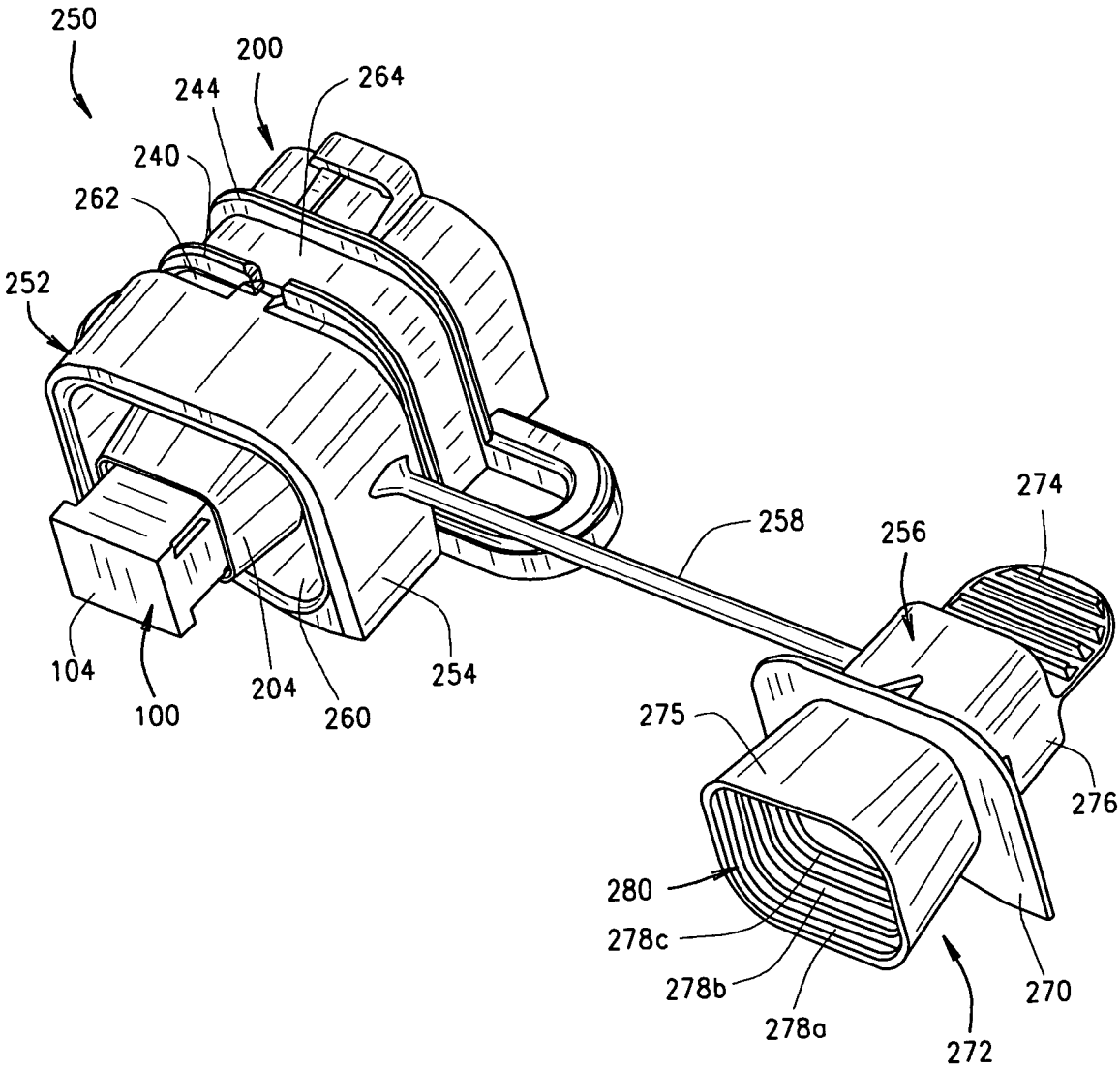
FIG. 7 illustrates the assembly of FIG. 6 with a protective cover attached thereto in an opened position.

FIG. 7 illustrates a fuse holder assembly 250 including the fuse 100 installed in the connector portion 204 of the fuse holder 200, and a protective cover 252 installed over the fuse receptacle portion 204. The cover 252 may be fabricated from a resilient elastomeric material, and as shown in FIG. 7 the cover 252 may include a shroud 254 and a lid 256 interconnected by a tether 258. The tether 258 is flexible and secures the shroud 254 and the lid 256 to one another in the open position to prevent inadvertent loss of the lid 256.

The shroud 254 may be formed in a generally hollow rectangular shape in an exemplary embodiment, and may be of a substantially larger dimension than the fuse receptacle portion 204 of the fuse holder 200. The larger dimension of the shroud 254 may define a clearance or gap 260 between outer surfaces of the fuse receptacle portion 204 and inner surfaces of the shroud 254 when the shroud 254 is inserted over the fuse receptacle portion 204 of the fuse holder 200. An inwardly tapered lip 262 may be formed on a forward edge of the shroud 254, and the lip 262 may resiliently engage the outer surfaces of the fuse holder 200 adjacent the cover abutment flange 240.

A retaining deflectable retaining tab 264 may be formed with and extend from the forward end of the shroud 254. When the shroud 254 is fully inserted over the fuse receptacle portion 204 and the lip 262 is in abutting contact with the flange 240, the tab 264 may be pressed downwardly into the space between the flanges 240 and 244. Resilient deformation of the tab 264 between the flanges 240 and 244 maintains the shroud 254 in position relative to the fuse holder 200. Further, the flanges 240 and 244 are taller than the tab 264, and some effort is required to remove the tab 264 from between the flanges 240 and 244, thereby reducing, if not eliminating, inadvertent or accidental separation of the shroud 254 from the fuse holder 200.

Figure 8:
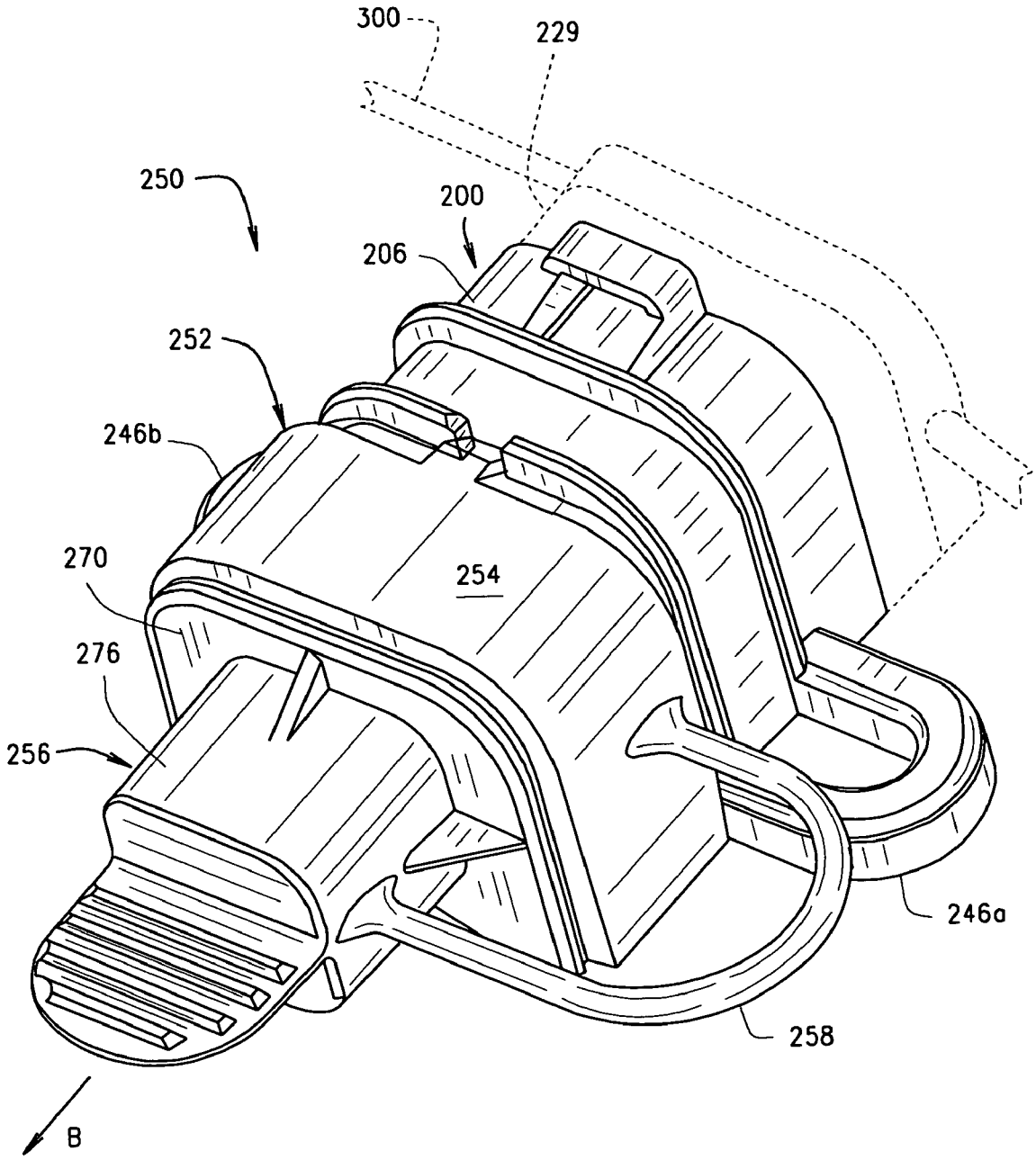
FIG. 8 illustrates the assembly of FIG. 7 with the cover in a closed position.

The lid 256 may include a cover plate 270, an open-ended hood 272 extending from the cover plate 270, and a finger pull tab 274 extending from one end of the hood 272. The hood 272 includes an outwardly flared conical portion 275 extending from one side of the cover plate 270, and a generally rectangular shaped head portion 276 extending on the opposite side of the cover plate 270. The conical portion 275 is complementary in shape to the fuse receptacle portion 204 of the fuse holder 200, and the conical portion 275 includes sealing ribs 278*a*, 278*b*, 278*c* that engage the sealing ribs 219*a*, 219*b*, 219*c* (FIG. 3) of the fuse receptacle portion 204 when the lid 256 is moved to the closed position shown in FIG. 8. When the lid 256 is moved to the closed position, the exposed portion of the fuse 100 extending from the fuse holder 200 is received in a receptacle or cavity 280 formed in the conical portion 275 and extending into the head portion 276 of the hood. As shown in FIG. 8, when the lid 256 is closed, the cover plate 270 is generally coextensive with the open end of the shroud 254. The combination of the cover plate 270 and the conical portion 275 of the hood 272 sealingly engaging the fuse receptacle portion 204 of the fuse holder 200 is believed to provide superior protection of the fuse 100 from the elements.

From the closed position shown in FIG. 8, the lid 256 may be moved to the opened position shown in FIG. 7 by pulling on the finger tab 274 in the direction of Arrow B away from the fuse holder 200. In the open position, the fuse 100 may be inspected with the cover 104 of the fuse 100 exposed, and if necessary, the fuse 100 may be easily removed and replaced with plug-in convenience.

Additionally, when used with the connector 229 (shown in phantom in FIG. 8), the assembly 250 may be connected to a wiring harness 300 (also shown in phantom) with plug-in convenience via the connector portion 206 of the fuse holder 200. Advantageously, spliced connections may be avoided. Mounting structure is provided via the lugs 246*a* and 246*b*, and the sealing action of the lid 256 and the protection of the shroud 254 render the assembly 250 acceptable for extreme operating environments, including but not limited to under-the-hood installations in a vehicle.

The shroud 254 and/or the lid 256 may be color coded to match color coded ratings for the fuse 100, and as shown in the Figures, the shroud may include indicia corresponding to a rating of the fuse, such as the "50" rating shown in the illustrative embodiment. Thus, the type and rating of the fuse may be apparent for maintenance of the electrical system even while the lid 256 is closed and the fuse 100 is concealed within the lid 256 and the shroud 254. The keys 234 and 234*b* (FIG. 5) also may be utilized to ensure that the type and rating of the fuse is matched with the appropriate fuse holder and connector. As one example, a 50A fuse having a color code of red and a red cover may be provided with a matching red fuse holder and lid, and the keys 234*a* and 234*b* may frustrate any attempt to connect a red fuse holder to connectors that are not appropriately rated for a red fuse. A number of different colors and keys may be provided to supply a full line of fuses, holders for the fuses, and connectors to connect them to circuitry to be protected. A convenient and reliable in-line fuse holder assembly is therefore provided for a female fuse 100 that may meet the challenges of under-the-hood installations, and reduce installation errors and mismatching of fuses, holders and connectors.

An embodiment of a fuse holder is disclosed herein that comprises a housing comprising a fuse receptacle portion and a connector portion, wherein the fuse receptacle portion is configured to receive a female fuse.

Optionally, the housing may extend along a longitudinal axis, and the fuse receptacle portion may extend opposite the fuse connector portion along the longitudinal axis. Each of the fuse receptacle portion and the connector portion may comprise a pair of contact blades, with the contact blades being differently configured from one another. Each of the fuse receptacle portion and the connector portion comprise a pair of contact blades, each of the contact blades in each pair being spaced a distance from one another, wherein the spacing of the contact blades in the fuse receptacle portion is different from the spacing of the contact blades in the connector portion. The fuse receptacle portion may be substantially rectangular, and the fuse receptacle portion may comprise a sealing rib. The housing may include an abutment flange, with the abutment flange having a gap therein. A protective cover may be provided, with the cover attached to the fuse receptacle portion, and the cover may comprise at least one sealing rib. A shroud may extend over the fuse receptacle portion, and a lid may be connected the shroud. The shroud may extend over the fuse receptacle portion, and the shroud may comprise indicia corresponding to a rating of the fuse. At least one mounting lug may extend from the housing, and the mounting lug may extend at an angle from the fuse receptacle portion.

An embodiment of a fuse holder is also disclosed herein. The fuse holder comprises a housing; a fuse receptacle portion extending from one side of said housing, the fuse receptacle portion being configured to receive a female fuse; and a connector portion extending from another side of said housing, the connector portion defining a receptacle having a pair of contact blades therein.

Optionally, the fuse receptacle portion and the connector portion are oriented substantially 180° from one another. The fuse receptacle portion may be substantially rectangular. The fuse receptacle portion may include at least one sealing rib circumscribing the receptacle portion. The fuse receptacle portion may be conical. The fuse receptacle portion may define a receptacle having a pair of contact blades, with the contact blades of the fuse receptacle portion being spaced a first distance from one another, wherein the contact blades in the connector portion are spaced a second distance from one another, and wherein the first and second distances are unequal. A protective cover may be attached to the fuse receptacle portion, with the cover comprising a shroud portion and a lid portion, the shroud portion and the lid portion being connected by a tether.

The shroud may be hollow and may extend over the fuse receptacle portion, and the lid may comprise a cover plate being substantially coextensive with an opening in the shroud when the lid is closed. The shroud may be separately provided from the housing and may comprise indicia corresponding to a rating of the fuse. At least one mounting lug may extend from the housing, with the mounting lug extending at an angle from the fuse receptacle portion.

An embodiment of a fuse holder assembly is also disclosed. The assembly comprises a housing comprising opposed first and second sides; a fuse receptacle portion extending from the first side of said housing, the fuse receptacle portion defining a first receptacle and a first set of contact blades in the first receptacle; a connector portion extending from the second side of the housing, the connector portion defining a second receptacle and second set of contact blades therein; a female fuse inserted in the first receptacle and partly exposed therefrom; a shroud coupled to the fuse receptacle portion over the fuse; and a lid selectively positionable relative to the shroud between an opened position and a closed position.

Optionally, the fuse receptacle portion is substantially rectangular. The fuse receptacle portion may include a first sealing rib circumscribing the receptacle portion, and the lid may comprise a second sealing rib engaging the first rib when the lid is closed. The first set of contact blades may be spaced a first distance from one another, wherein the second set of contact blades is spaced a second distance from one another, and wherein the first and second distances are unequal. The shroud portion and the lid portion may be connected by a tether. The lid may comprise a cover plate and a finger pull tab, with the cover plate being substantially coextensive with an opening in the shroud when the lid is closed. The shroud may comprise indicia corresponding to a rating of the fuse. Mounting lugs may extend from the housing, with the mounting lugs extending at an angle from the fuse receptacle portion.

An embodiment of an in-line fuse holder system is also disclosed. The system comprises a fuse comprising a housing and female terminal portions therein; a housing comprising first and second receptacles each having contact blades therein, the first receptacle adapted to receive the fuse with plug-in connection and establish electrical contact therewith, and the second contact receptacle adapted to receive a connector with plug-in connection.

Optionally, the first and second receptacles may be located 180° from one another on the housing. The housing may comprise a flange projecting outwardly therefrom, and the system may further comprise a shroud, with a portion of the shroud resiliently deflected over the flange to secure the shroud to the housing. The fuse receptacle may comprise a series of sealing ribs, and the system may further comprising a lid, the lid comprising a second series of sealing ribs, and the lid being fitted over the fuse receptacle portion. The connector may be coupled to a wiring harness. 36. The fuse may be color coded to indicate a rating of the fuse, and the housing may be color coded to match the fuse, thereby providing visual indication of the rating of the housing A lid may be coupled to the housing, with the lid being color coded to match the fuse.

While the invention has been described in terms of various specific embodiments, those skilled in the art will recognize that the invention can be practiced with modification within the spirit and scope of the claims.

What is claimed is:

1. A fuse holder comprising:

a housing comprising a fuse receptacle portion having a first pair of contact blades for mating with and electrically connecting to a female fuse;

a connector portion having a second pair of contact blades, wherein a first of said second pair of contact blades provides electrical connection to at least one line-side component and a second of said second pair of contact blades provides electrical connection to at Least one load-side component; and a protective cover attached to the fuse receptacle portion, the cover comprising at least one sealing rib;

wherein the first pair of contact blades provide pass-through electrical connection to the second pair of contact blades.

2. The fuse holder of claim 1, wherein the housing extends along a longitudinal axis, and the fuse receptacle portion extends on a side of the housing opposite the fuse connector portion along the longitudinal axis.

3. The fuse holder of claim 1, wherein the first pair of contact blades is differently configured from the second pair of contact blades.

4. The fuse holder of claim 1, wherein the first pair of contact blades are spaced apart from each other by a first distance; and wherein the second pair of contact blades are spaced apart from each other by a second distance that is not equal to the first distance.

5. The holder of claim 1, wherein the fuse receptacle portion is substantially rectangular.

6. The fuse holder of claim 1, wherein the fuse receptacle portion comprises a sealing rib.

7. The fuse holder of claim 1, wherein the housing includes an abutment flange, the abutment flange having a gap therein.

8. The fuse holder of claim 1, further comprising at least one mounting lug extending from the housing, the mounting lug extending at an angle from the fuse receptacle portion.

9. A fuse holder comprising:

a housing;

a fuse receptacle portion extending from one side of said housing, the fuse receptacle portion having a first pair of contact blades for mating with and electrically connecting to a female fuse;

a connector portion extending from another side of said housing, the connector portion defining a receptacle having a second pair of contact blades therein, wherein a first of said second pair of contact blades provides electrical connection to at least one line-side component and a second of said second pair of contact blades provides electrical connection to at least one load-side component; and a protective cover attached to the fuse receptacle portion, the cover comprising a shroud portion and a lid portion, the shroud portion and the lid portion being connected by a tether;

wherein the first pair of contact blades provide pass-through electrical connection to the second pair of contact blades.

10. The fuse holder of claim 9, wherein the fuse receptacle portion and the connector portion are oriented substantially 180° from one another.

11. The fuse holder of claim 9, wherein the fuse receptacle portion is substantially rectangular.

12. The fuse holder of claim 9, wherein the fuse receptacle portion includes at least one sealing rib circumscribing the receptacle portion.

13. The fuse holder of claim 9, wherein the fuse receptacle portion is conical.

14. The fuse holder of claim 9, wherein the first pair of contact blades are spaced apart from one another by a first distance; and wherein the second pair of contact blades are spaced apart from one another by a second distance, that is not equal to the first distance.

15. The fuse holder of claim 9, further comprising at least one mounting lug extending from the housing, the mounting lug extending at an angle from the fuse receptacle portion.

16. A fuse holder assembly comprising:

a housing comprising opposed first and second sides;

a fuse receptacle portion extending from the first side of said housing, the fuse receptacle portion defining a first receptacle and a first set of contact blades in the first receptacle;

a connector portion extending from the second side of the housing, the connector portion defining a second receptacle and second set of contact blades therein, wherein a first of said second pair of contact blades provides electrical connection to at least one line-side component and a second of said second pair of contact blades provides electrical connection to at least one load-side component, and wherein a pass-through electrical connection is provided between the first set of contact blades and the second set of contact blades;

a female fuse mated with the first set of contact blades so as to be inserted in the first receptacle and partly exposed therefrom;

a shroud coupled to the fuse receptacle portion over the fuse; and a lid selectively positionable relative to the shroud between an opened position and a closed position.

17. The assembly of claim 16, wherein the fuse receptacle portion is substantially rectangular.

18. The assembly of claim 16, wherein the fuse receptacle portion includes a first sealing rib circumscribing the receptacle portion, and the lid comprises a second sealing rib engaging the first rib when the lid is closed.

19. The assembly of claim 16, wherein the first set of contact blades is spaced a first distance from one another, wherein the second set of contact blades is spaced a second distance from one another, and wherein the first and second distances are unequal.

20. The assembly of claim 16, wherein the shroud portion and the lid portion are connected by a tether.

21. The assembly of claim 16, wherein the lid comprises a cover plate and a finger pull tab, the cover plate being substantially coextensive with an opening in the shroud when the lid is closed.

22. The assembly of claim 16, wherein the shroud comprises indicia corresponding to a rating of the fuse.

23. The assembly of claim 16, further comprising mounting lugs extending from the housing, the mounting lugs extending at an angle from the fuse receptacle portion.

24. The fuse holder assembly of claim 16, wherein the fuse holder housing comprises a flange projecting outwardly therefrom.

25. An in-line fuse holder system comprising:

a fuse comprising female terminal portions;

a fuse holder housing comprising a first receptacle having a first set of contact blades therein, a second receptacle having a second set of contact blades therein, and a flange protecting outwardly therefrom; and a shroud, a portion of the shroud resiliently deflected over the flange to secure the shroud to the fuse holder housing;

wherein the first set of contact blades mates with the female terminal portions of the fuse with plug-in connection and establishes electrical contact therewith;

wherein the second set of contact blades is adapted to receive a connector with plug-in connection, said connector providing electrical connection to at least one line-side component and at least one load-side component; and wherein a pass-through electrical connection is provided between the first set of contact blades and the second set of contact blades such that the fuse provides over-current protection to the connector.

26. The system of claim 25, wherein the first and second receptacles are located 180° from one another on the fuse holder housing.

27. The system of claim 25, wherein the connector is coupled to a wiring harness.

28. The system of claim 25, wherein the second receptacle includes a polarizing key.

29. The system of claim 25, wherein the fuse is color coded for a fuse rating, and the fuse holder housing is color coded to match the fuse, thereby providing visual indication of the rating of the fuse holder housing.

30. A fuse holder comprising:

a housing comprising a fuse receptacle portion having a first pair of contact blades for mating with and electrically connecting to a female fuse;

a connector portion having a second pair of contact blades, wherein a first of said second pair of contact blades provides electrical connection to at least one line-side component and a second of said second pair of contact blades provides electrical connection to at least one load-side component; and a shroud extending over the fuse receptacle portion, and a lid connected to the shroud;

wherein the first pair of contact blades provide pass-through electrical connection to the second pair of contact blades.

31. A fuse holder comprising:

a housing comprising a fuse receptacle portion having a first pair of contact blades for mating with and electrically connecting to a female fuse;

a connector portion having a second pair of contact blades, wherein a first of said second pair of contact blades provides electrical connection to at least one line-side component and a second of said second pair of contact blades provides electrical connection to at least one load-side component; and a shroud extending over the fuse receptacle portion, the shroud comprising indicia corresponding to a rating of the fuse;

wherein the first pair of contact blades provide pass-through electrical connection to the second pair of contact blades.

32. A fuse holder comprising:

a housing;

a fuse receptacle portion extending from one side of said housing, the fuse receptacle portion having a first pair of contact blades for mating with and electrically connecting to a female fuse;

a connector portion extending from another side of said housing, the connector portion defining a receptacle having a second pair of contact blades therein, wherein a first of said second pair of contact blades provides electrical connection to at least one line-side component and a second of said second pair of contact blades provides electrical connection to at least one load-side component; and a hollow shroud extending over the fuse receptacle portion, and a lid connected the shroud, the lid comprising a cover plate being substantially coextensive with an opening in the shroud when the lid is closed;

wherein the first pair of contact blades provide pass-through electrical connection to the second pair of contact blades.

33. A fuse holder comprising:

a housing;

a fuse receptacle portion extending from one side of said housing, the fuse receptacle portion having a first pair of contact blades for mating with and electrically connecting to a female fuse;

a connector portion extending from another side of said housing, the connector portion defining a receptacle having a second pair of contact blades therein, wherein a first of said second pair of contact blades provides electrical connection to at least one line-side component and a second of said second pair of contact blades provides electrical connection to at least one load-side component; and a shroud extending over the fuse receptacle portion, the shroud being separately provided from the housing and comprising indicia corresponding to a rating of the fuse;

wherein the first pair of contact blades provide pass-through electrical connection to the second pair of contact blades.

34. An in-line fuse holder system comprising:

a fuse comprising female terminal portions;

a fuse holder housing comprising a first receptacle having a first set of contact blades therein and a first series of sealing ribs located circumferentially around the outer surface of the first receptacle; and a second receptacle having a second set of contact blades therein; and a lid comprising a second series of sealing ribs, the lid being fitted over the first receptacle;

wherein the first set of contact blades mates with the female terminal portions of the fuse with plug-in connection and establishes electrical contact therewith;

wherein the second set of contact blades is adapted to receive a connector with plug-in connection, said connector providing electrical connection to at least one line-side component and at least one load-side component; and wherein a pass-through electrical connection is provided between the first set of contact blades and the second set of contact blades such that the fuse provides over-current protection to the connector.

35. An in-line fuse holder system comprising:

a fuse comprising female terminal portions, wherein the fuse is color coded for a fuse rating;

a fuse holder housing comprising a first receptacle having a first set of contact blades therein and a second receptacle having a second set of contact blades therein, wherein the fuse holder housing is color coded to match the fuse, thereby providing visual indication of the rating of the fuse holder housing; and a lid coupled to the fuse holder housing, wherein, the lid is color coded to match the fuse;

wherein the first set of contact blades mates with the female terminal portions of the fuse with plug-in connection and establishes electrical contact therewith;

wherein the second set of contact blades is adapted to receive a connector with plug-in connection, said connector providing electrical connection to at least one line-side component and at least one load-side component; and wherein a pass-through electrical connection is provided between the first set of contact blades and the second set of contact blades such that the fuse provides over-current protection to the connector.

* * * * *